US006467109B1

(12) United States Patent
Wu

(10) Patent No.: US 6,467,109 B1
(45) Date of Patent: Oct. 22, 2002

(54) HAMMOCK ASSEMBLY

(76) Inventor: Chung-Sen Wu, 3F, No. 8, Ione 295, Sec. 1, Fu Sing Nan Rd., Taipei (TW)

( * ) Notice: Subject to any disclaimer, the term of this patent is extended or adjusted under 35 U.S.C. 154(b) by 0 days.

(21) Appl. No.: 09/930,058

(22) Filed: Aug. 15, 2001

(51) Int. Cl.[7] ..... A45F 3/24
(52) U.S. Cl. ..... 5/120; 5/127; 5/130
(58) Field of Search ..... 5/120, 122, 127, 5/129, 130; 472/118, 125

(56) References Cited

U.S. PATENT DOCUMENTS

| | | | | | |
|---|---|---|---|---|---|
| 506,776 | A | * | 10/1893 | Ford | 5/129 |
| 531,727 | A | * | 1/1895 | Keegan et al. | 5/128 |
| 4,691,394 | A | * | 9/1987 | Woo | 5/120 |
| 5,003,652 | A | * | 4/1991 | Bayless | 5/122 |
| 5,297,302 | A | * | 3/1994 | Anderson | 403/174 |
| 5,392,476 | A | * | 2/1995 | Williams | 248/166 |
| 5,983,422 | A | * | 11/1999 | Bayless | 5/120 |

* cited by examiner

*Primary Examiner*—Heather Shackelford
*Assistant Examiner*—Fredrick Conley
(74) *Attorney, Agent, or Firm*—Alan Kamrath; Rider, Bennett, Egan & Arundel, LLP

(57) ABSTRACT

A hammock assembly has a bed net, and a foldable support frame. The bed net has two opposite hoop devices. The foldable support frame has a pair of base rods, a pair of left lifting rods, a pair of right lifting rods, two pairs of connectors, two pairs of connection rods, a pair of connection bars, and a pair of hook devices. One pair of connectors fasten the base rods and the right lifting rods together. The other pair of connectors fasten the base rods and the left lifting rods together. One hook device is connected to the right lifting rods. The other hook device is connected to the left lifting rods. One connection bar is disposed on one right lifting rod and connected to the other right lifting rod. The other connection bar is disposed on one left lifting rod and connected to the other left lifting rod. One pair of connection rods are disposed on the corresponding base rods and connected to the corresponding right lifting rods. The other pair of connection rods are disposed on the corresponding base rods and connected to the corresponding left lifting rods. The hoop devices engage with the hook devices.

3 Claims, 8 Drawing Sheets

HAMMOCK ASSEMBLY

BACKGROUND OF THE INVENTION

The present invention relates to a hammock assembly. More particularly, the present invention relates to a hammock assembly which has a foldable support frame.

A conventional hammock is often suspended on trees. However, the trees will be damaged after a long period of usage.

SUMMARY OF THE INVENTION

An object of the present invention is to provide a hammock assembly which has a foldable support frame to support a bed net.

Another object of the present invention is to provide a hammock assembly which is folded easily.

Accordingly, a hammock assembly comprises a bed net, and a foldable support frame to support the bed net. The bed net has two opposite hoop devices. The foldable support frame has a pair of base rods; a pair of left lifting rods, a pair of right lifting rods, two pairs of connectors, two pairs of connection rods, a pair of connection bars, and a pair of hook devices. One pair of connectors fasten the base rods and the right lifting rods together. The other pair of connectors fasten the base rods and the left lifting rods together. Each of the connection rods has a comb-shaped end. Each of the connection bars has an end comb. Each of the right lifting rods has a first protruded block, and a second protruded block. Each of the left lifting rods has a first protrusion and a second protrusion. One hook device is connected to the right lifting rods. The other hook device is connected to the left lifting rods. One connection bar is disposed on one right lifting rod and engaged with the second protruded block of the other right lifting rod. The other connection bar is disposed on one left lifting rod and engaged with the second protrusion of the other left lifting rod. One pair of connection rods are disposed on the corresponding base rods and connected to the corresponding right lifting rods. The other pair of connection rods are disposed on the corresponding base rods and connected to the corresponding left lifting rods. The hoop devices engage with the hook devices.

DETAILED DESCRIPTION OF THE INVENTION

Figure 1:
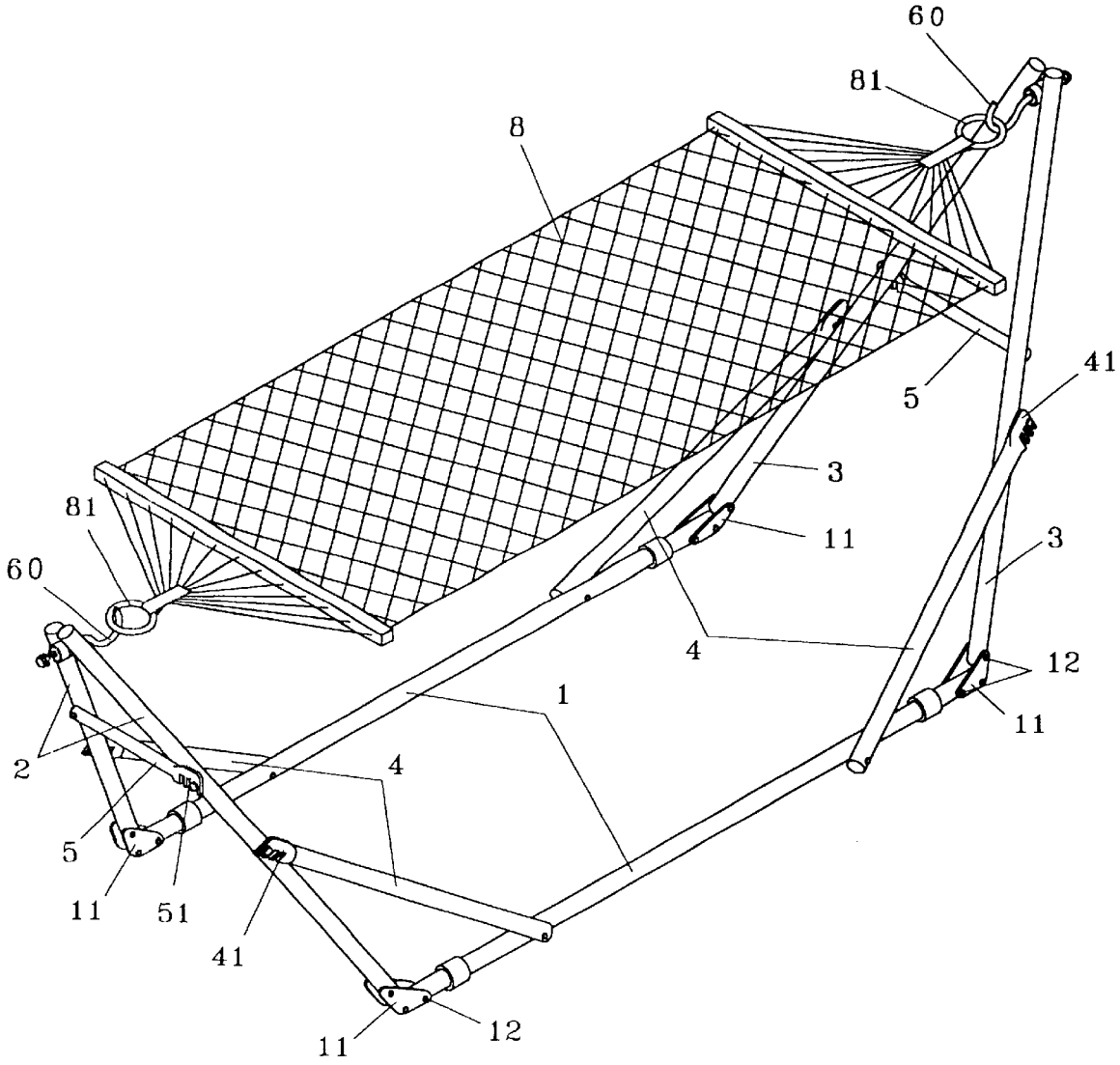
FIG. 1 is a perspective assembly view of a hammock assembly of a preferred embodiment in accordance with the present invention.
Figure 2:
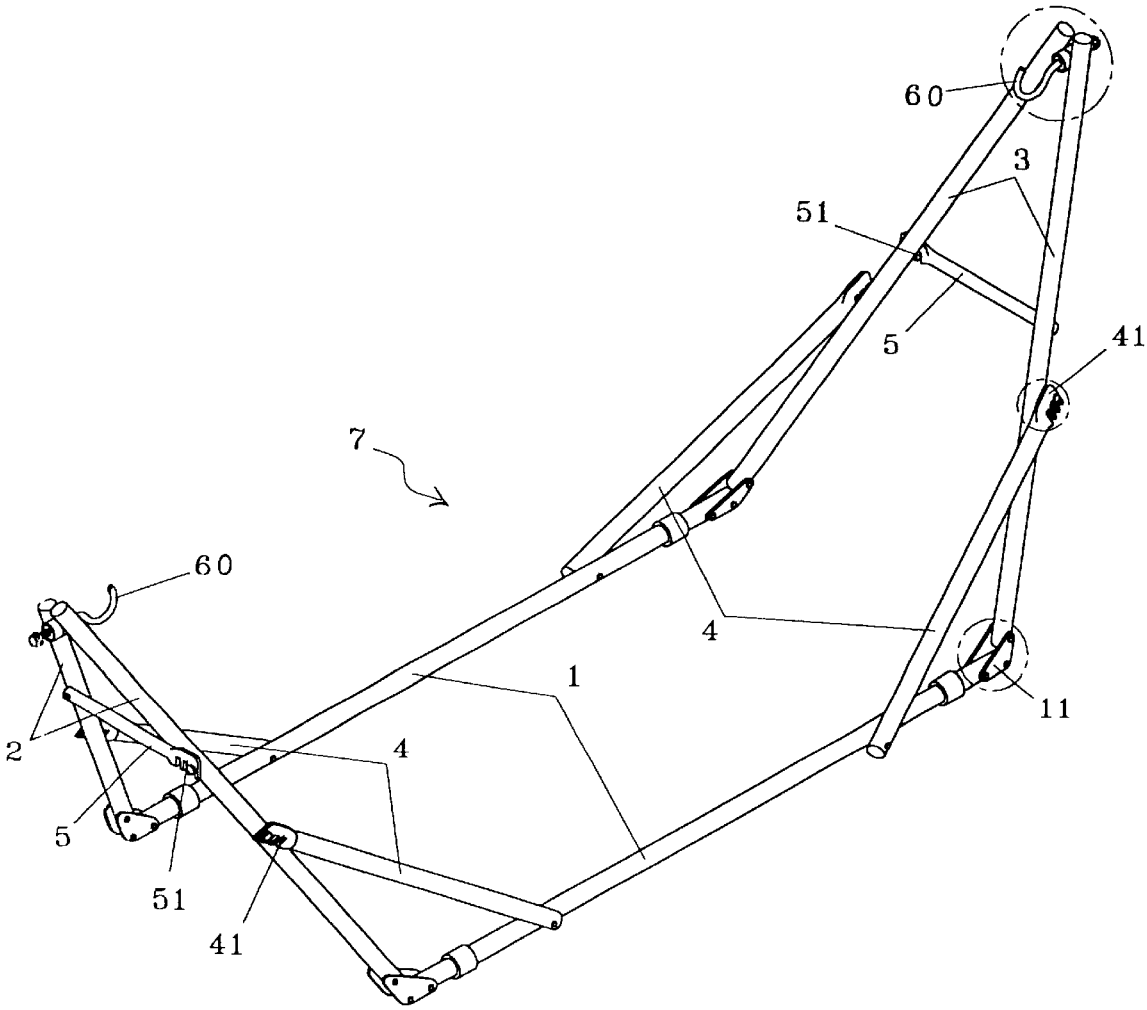
FIG. 2 is a perspective assembly view of a foldable support frame of a preferred embodiment in accordance with the present invention.
Figure 2A:
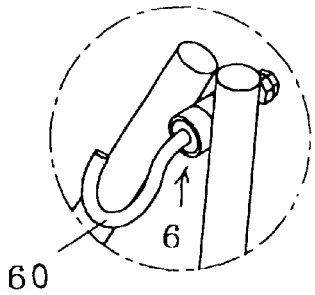
FIG. 2A is a perspective view of a hook device of a preferred embodiment in accordance with the present invention.
Figure 2B:
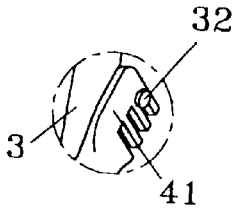
FIG. 2B is a partially perspective view of a connection rod of a preferred embodiment in accordance with the present invention.
Figure 2C:
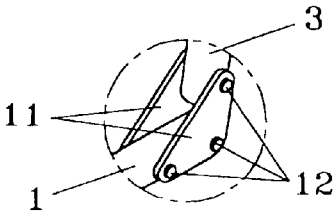
FIG. 2C is a schematic view illustrating a connector fastening a base rod and a right lifting rod together.
Figure 3:
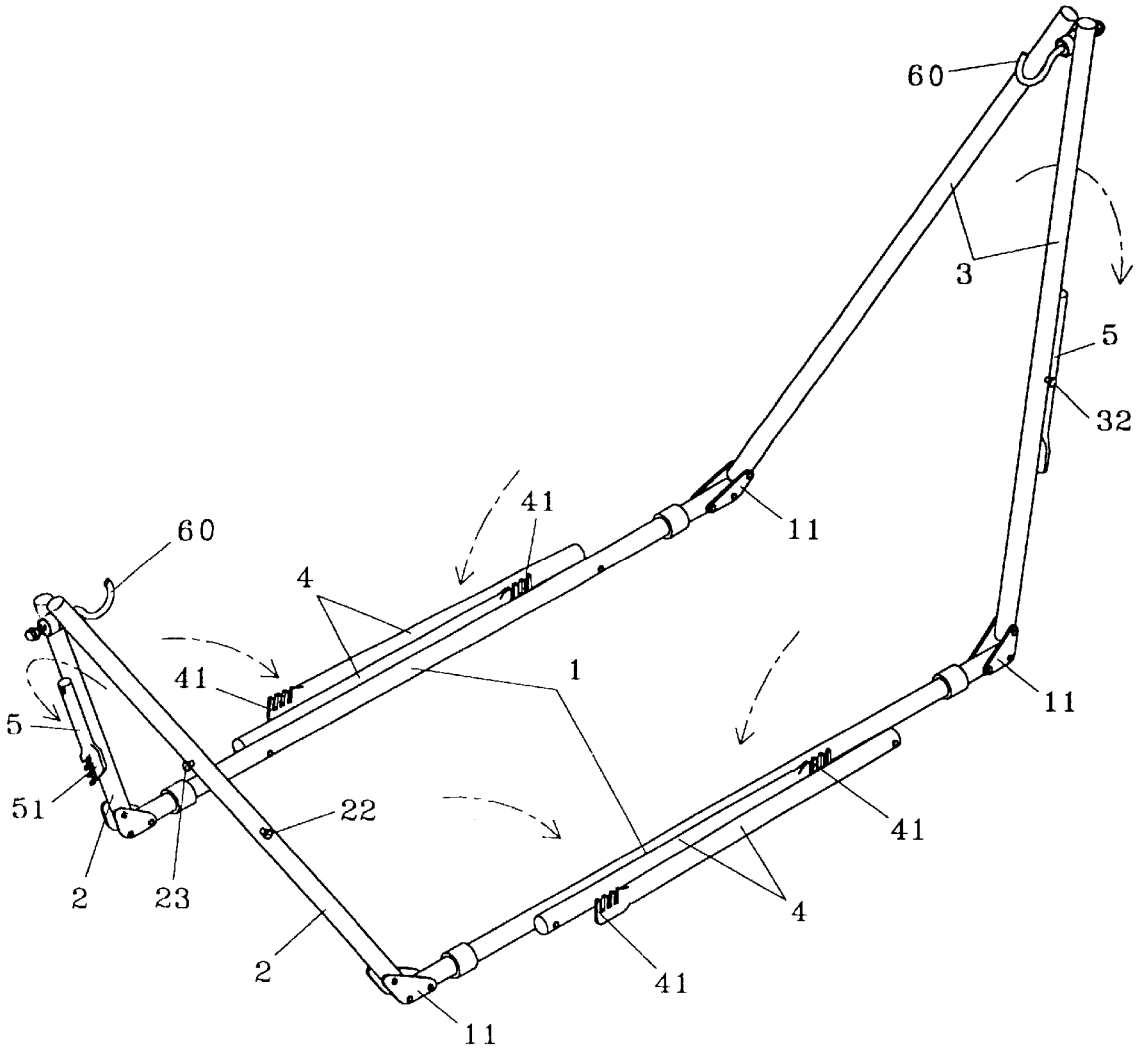
FIG. 3 is a perspective assembly view of a foldable support frame of a preferred embodiment while four connection rods are folded.
Figure 4:
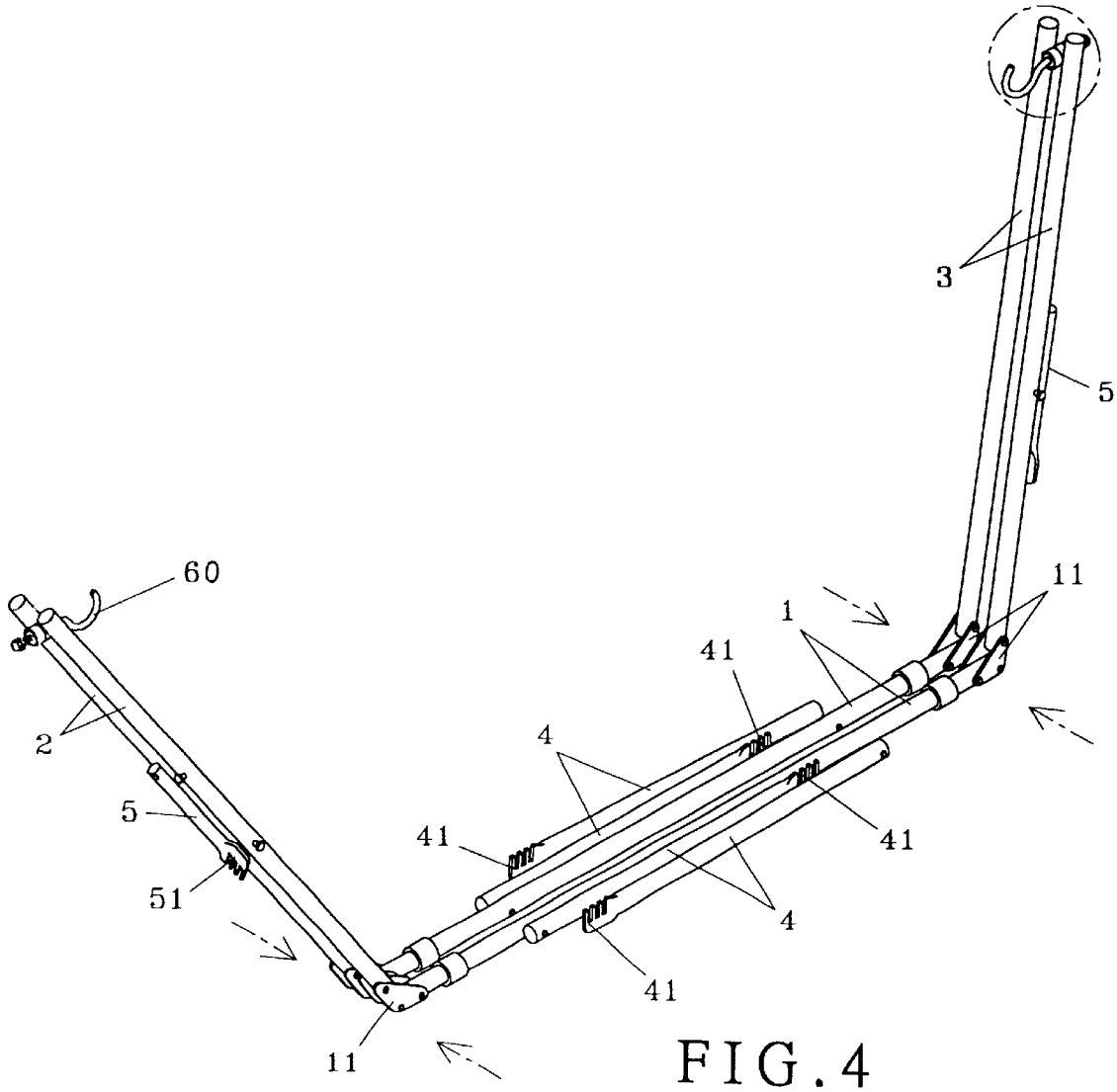
FIG. 4 is a schematic view illustrating two base rods, two left lifting rods, and two right lifting rods are combined.
Figure 4A:
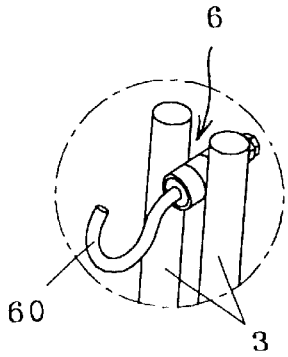
FIG. 4A is another perspective view of a hook device of a preferred embodiment in accordance with the present invention.
Figure 5:
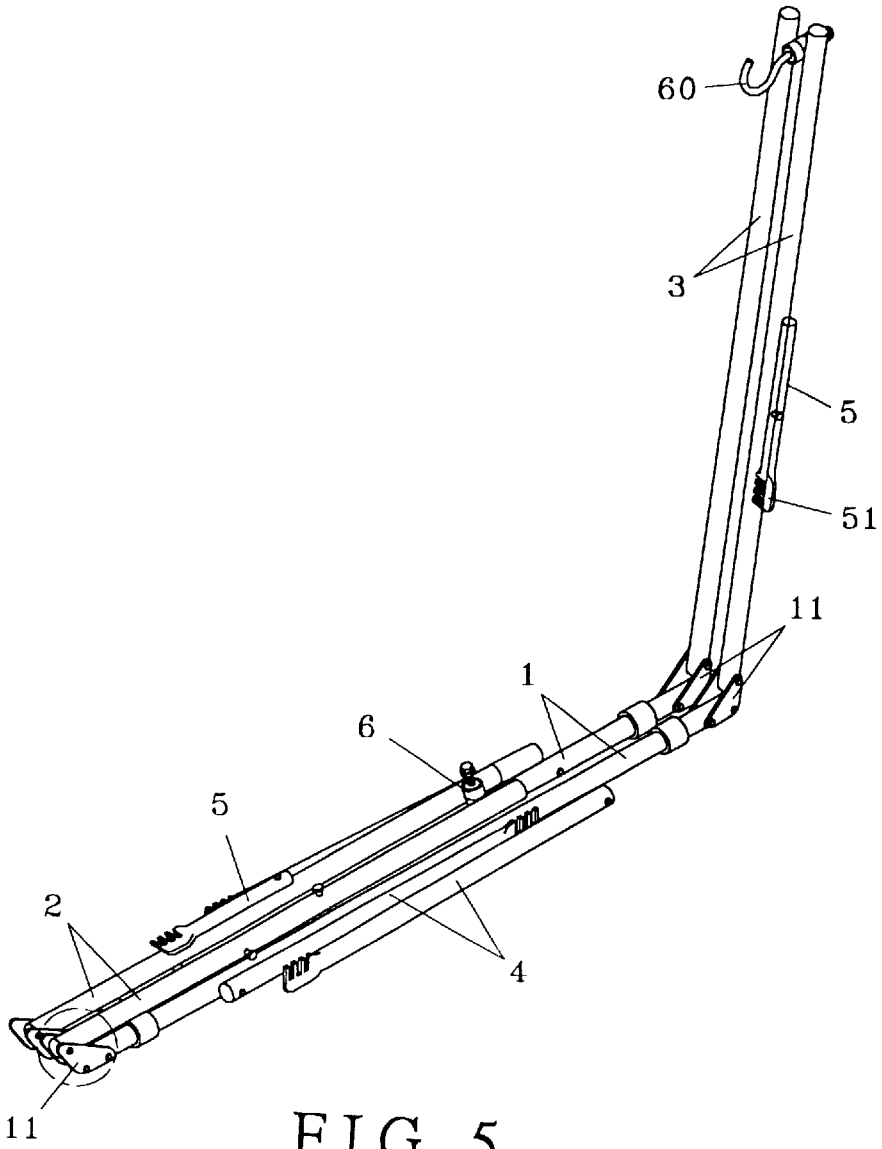
FIG. 5 is a schematic view illustrating two left lifting rods are folded.
Figure 5A:
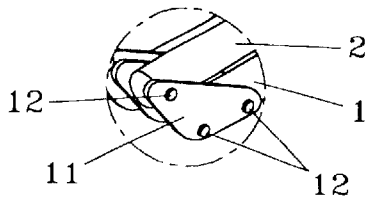
FIG. 5A is a perspective view of a connector of a preferred embodiment in accordance with the present invention.
Figure 6:
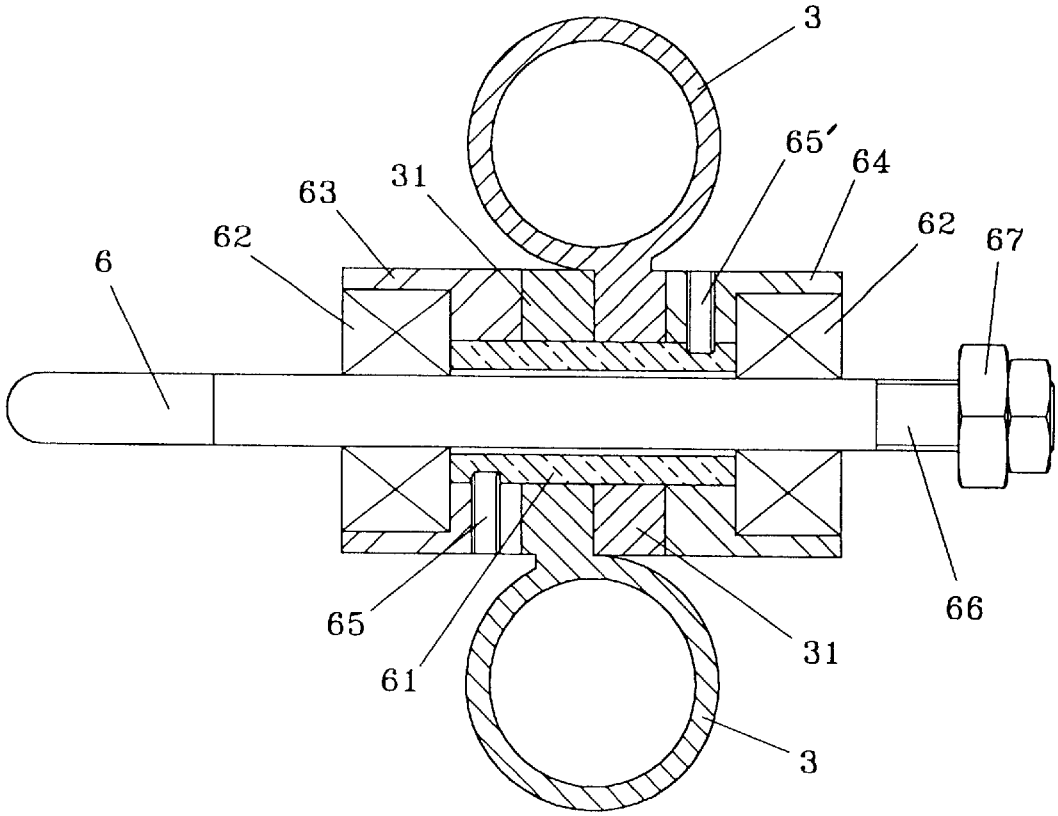
FIG. 6 is a partially sectional view of FIG. 4A.
Figure 7:
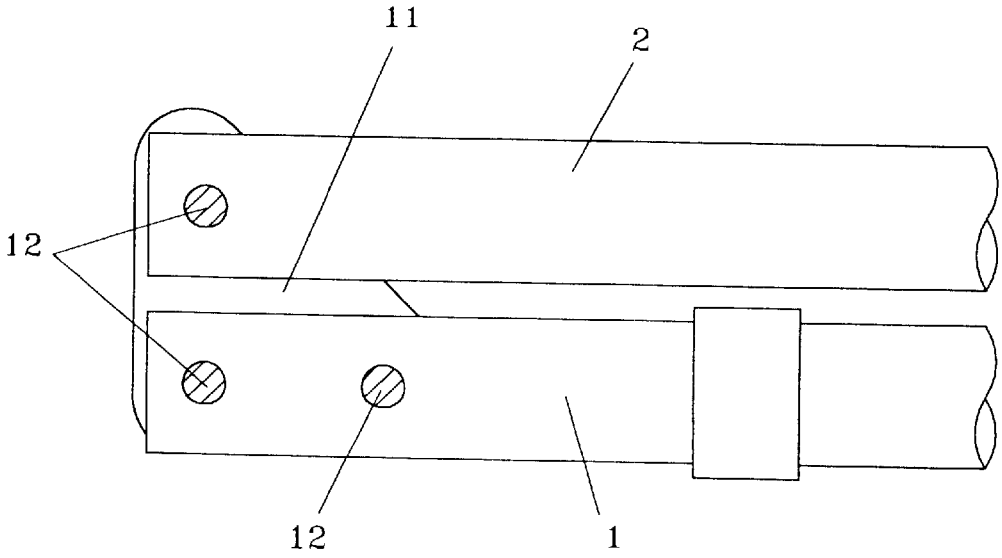
FIG. 7 is a schematic view illustrating a connector fastening a base rod and a left lifting rod together.
Figure 8:
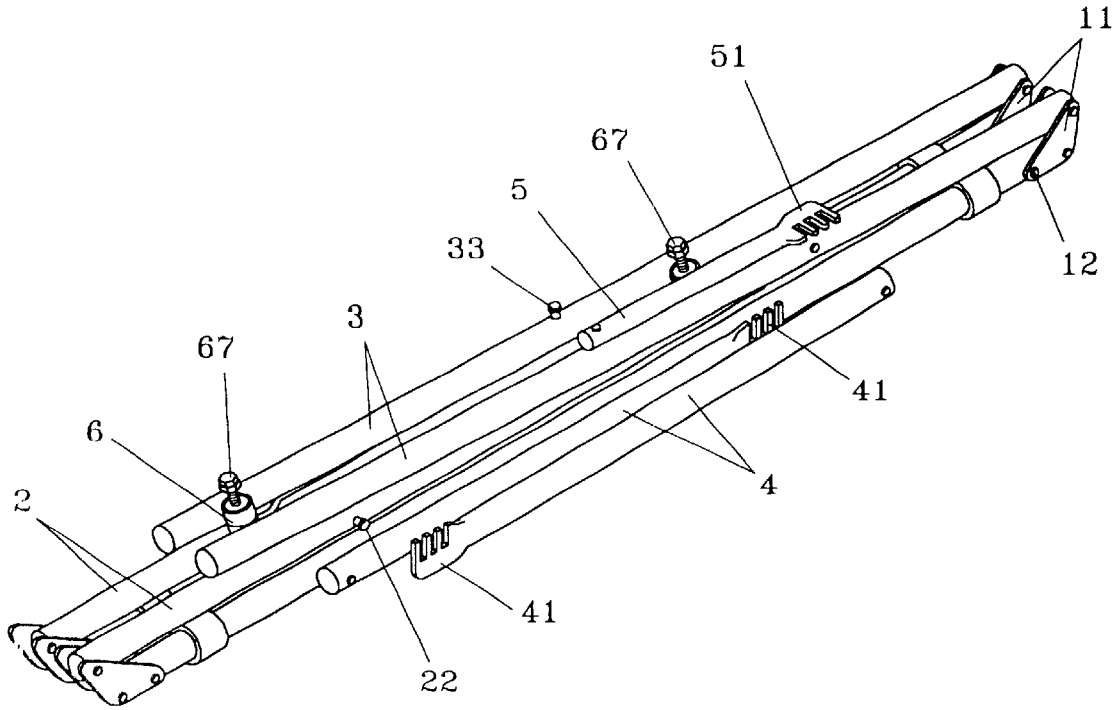
FIG. 8 is a schematic view illustrating a foldable support frame of a preferred embodiment is folded into a compact configuration.

Referring to FIGS. 1 to 8, a hammock assembly comprises a bed net 8, and a foldable support frame 7 to support the bed net 30.

The bed net 8 has two opposite hoop devices 81.

The foldable support frame 7 has a pair of base rods 1, a pair of left lifting rods 2, a pair of right lifting rods 3, two pairs of connectors 11, two pairs of connection rods 4, a pair of connection bars 5, and a pair of hook devices 6.

One pair of connectors. 11 fasten the base rods 1 and the right lifting rods 3 together.

The other pair of connectors 11 fasten the base rods 1 and the left lifting rods 2 together.

Each of the connection rods 4 has a comb-shaped end 41.

Each of the connection bars 5 has an end comb 51.

Each of the right lifting rods 3 has a first protruded block 32, and a second protruded block 33.

Each of the left lifting rods 2 has a first protrusion 22 and a second protrusion 23.

One hook device 6 is connected to the right lifting rods 3.

The other hook device 6 is connected to the left lifting rods 2.

One connection bar 5 is disposed on one right lifting rod 3 and engaged with the second protruded block 33 of the other right lifting rod 3.

The other connection bar 5 is disposed on one left lifting rod 2 and engaged with the second protrusion 23 of the other left lifting rod 2.

One pair of connection rods 4 are disposed on the, corresponding base rods 1 and connected to the corresponding right lifting rods 3.

The other pair of connection rods 4 are disposed on the corresponding base rods 1 and connected to the corresponding left lifting rods 2.

The hoop devices 81 engage with the hook devices 6.

Each of the hook devices 6 has two opposite bearings 62, a first bearing block 63 receiving one bearing 62, a second bearing block 64 receiving the other bearing 62, a sleeve 61 disposed between the bearings 62, and a curved rod 60 passing through the bearings 62, the first bearing block 63, the sleeve 61, and the second bearing block 64.

Each of the right lifting rods 3 further has an end post 31 to be inserted through the corresponding sleeve 61.

A first stud 65 fastens the first bearing block 63 and the sleeve 61 together.

A second stud 65' fastens the second bearing block 64 and the sleeve 61 together.

A bolt 67 has a threaded portion 66 engages with the corresponding hook device 6 to confine the curved rod 60.

A plurality of rivets 12 are disposed on each of the connectors 11.

When the foldable support frame 7 is extended, one pair of connection rods 4 each engages with the corresponding first protruded block 32 and the other pair of connection rods 4 each engages with the corresponding first protrusion 22.

Referring to FIG. 3 again, the connection rods 4 are folded in order to fold the foldable support frame 7.

Referring to FIG. 4 again, the base rods 1 are combined, the left lifting rods 2 are combined, and the right lifting rods 3 are combined.

Referring to FIG. 5 again, the left lifting rods 2 are folded.

Referring to FIG. 8 again, the right lifting rods 3 are folded so that the foldable support frame 7 is folded into a compact configuration.

The present invention has the following advantages.

The present invention provides the foldable support frame to support the bed net.

The present invention provides the hammock assembly which is folded easily.

The present invention is not limited to the above embodiment but various modification thereof may be made. Furthermore, various changes in form and detail may be made without departing from the scope of the present invention.

I claim:

1. A hammock assembly comprises:

a bed net, and a foldable support frame to support the bed net, the bed net having two opposite hoop devices, the foldable support frame having a pair of base rods, a pair of left lifting rods, a pair of right lifting rods, two pairs of connectors, two pairs of connection rods, a pair of connection bars, and a pair of hook devices, one pair of connectors fastening the base rods and the right lifting rods together, the other pair of connectors fastening the base rods and the left lifting rods together, each of the connection rods having a comb-shaped end, each of the connection bars having an end comb, each of the right lifting rods having a first protruded block, and a second protruded block, each of the left lifting rods having a first protrusion and a second protrusion, one hook device connected to the right lifting rods, the other hook device connected to the left lifting rods, one connection bar disposed on one right lifting rod and engaged with the second, protruded block of the other right lifting rod, the other connection bar disposed on one left lifting rod and engaged with the second protrusion of the other left lifting rod, one pair of connection rods disposed on the corresponding base rods and connected to the corresponding right lifting rods, the other pair of connection rods disposed on the corresponding base rods and connected to the corresponding left lifting rods, and the hoop devices engage with the hook devices.

2. The hammock assembly as claimed in claim 1, wherein each of the hook devices has two opposite bearings, a first bearing block receiving one bearing, a second bearing block receiving the other bearing, a sleeve disposed between the bearings, and a curved rod passing through the bearings, the first bearing block, the sleeve, and the second bearing block, and each of the right lifting rods further has an end post to be inserted through the corresponding sleeve.

3. The hammock assembly as claimed in claim 2, wherein a first stud fastens the first bearing block and the sleeve together, and a second stud fastens the second bearing block and the sleeve together.

* * * * *

US006467109C1

(12) EX PARTE REEXAMINATION CERTIFICATE (5476th)

United States Patent
Wu

(10) Number: US 6,467,109 C1
(45) Certificate Issued: Aug. 15, 2006

(54) HAMMOCK ASSEMBLY

(75) Inventor: Chung-Sen Wu, 3F, No. 8, Ione 295, Sec. 1, Fu Sing Nan Rd., Taipei (TW)

(73) Assignee: Chung-Sen Wu, Taipei (TW)

Reexamination Request:
No. 90/007,224, Sep. 29, 2004

Reexamination Certificate for:

| | |
|---|---|
| Patent No.: | **6,467,109** |
| Issued: | **Oct. 22, 2002** |
| Appl. No.: | **09/930,058** |
| Filed: | **Aug. 15, 2001** |

(51) Int. Cl.
*A45F 3/24* (2006.01)

(52) U.S. Cl. ..... 5/120; 5/127; 5/130
(58) Field of Classification Search ..... None
See application file for complete search history.

(56) References Cited

U.S. PATENT DOCUMENTS 1,369,173 A 2/1921 Heyser
6,151,730 A 11/2000 Weston
6,253,396 B1 7/2001 Weston

FOREIGN PATENT DOCUMENTS

VN 3787 6/2000

*Primary Examiner*—Matthew C. Graham

(57) ABSTRACT

A hammock assembly has a bed net, and a foldable support frame. The bed net has two opposite hoop devices. The foldable support frame has a pair of base rods, a pair of left lifting rods, a pair of right lifting rods, two pairs of connectors, two pairs of connection rods, a pair of connection bars, and a pair of hook devices. One pair of connectors fasten the base rods and the right lifting rods together. The other pair of connectors fasten the base rods and the left lifting rods together. One hook device is connected to the right lifting rods. The other hook device is connected to the left lifting rods. One connection bar is disposed on one right lifting rod and connected to the other right lifting rod. The other connection bar is disposed on one left lifting rod and connected to the other left lifting rod. One pair of connection rods are disposed on the corresponding base rods and connected to the corresponding right lifting rods. The other pair of connection rods are disposed on the corresponding base rods and connected to the corresponding left lifting rods. The hoop devices engage with the hook devices.

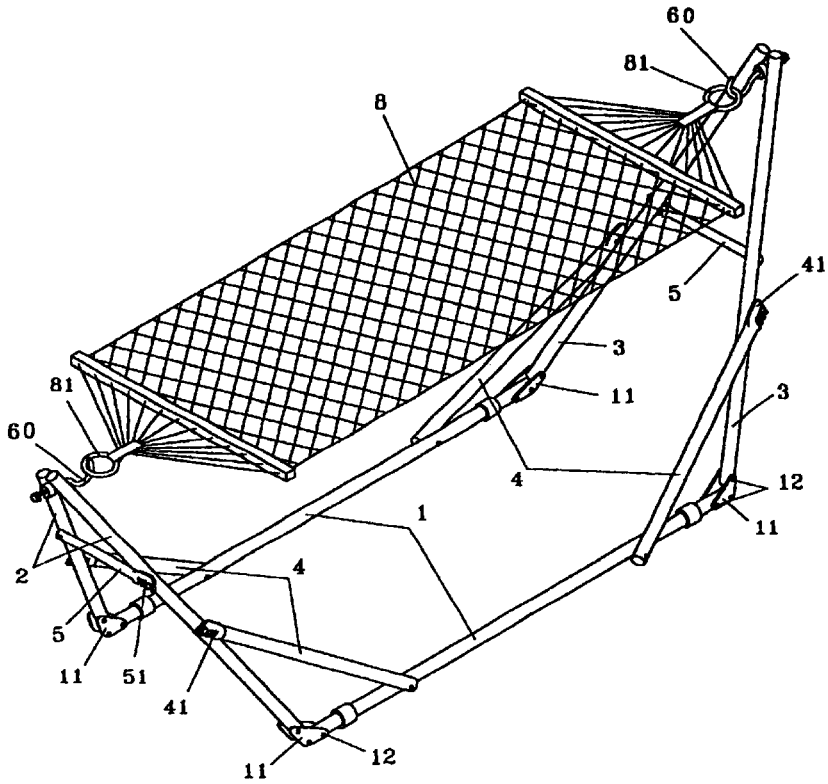

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2–3 is confirmed.

Claim 1 is cancelled.

* * * * *